US007427955B2

(12) United States Patent
Choi et al.

(10) Patent No.: US 7,427,955 B2
(45) Date of Patent: Sep. 23, 2008

(54) DUAL POLARIZATION ANTENNA AND RFID READER EMPLOYING THE SAME

(75) Inventors: Won-Kyu Choi, Gyeonggi-do (KR); Nak-Seon Seong, Gyeonggi-do (KR); Cheol-Sig Pyo, Daejeon (KR); Jong-Suk Chae, Daejeon (KR)

(73) Assignee: Electronics and Telecommunications Research Institute (KR)

( * ) Notice: Subject to any disclaimer, the term of this patent is extended or adjusted under 35 U.S.C. 154(b) by 241 days.

(21) Appl. No.: 11/297,182

(22) Filed: Dec. 7, 2005

(65) Prior Publication Data

US 2006/0145926 A1 Jul. 6, 2006

(30) Foreign Application Priority Data

Dec. 8, 2004 (KR) ..... 10-2004-0103079
Aug. 23, 2005 (KR) ..... 10-2005-0077357

(51) Int. Cl.
*H01Q 1/38* (2006.01)

(52) U.S. Cl. ..... 343/700 MS; 343/846

(58) Field of Classification Search ..... 343/700 MS, 343/702, 829, 846
See application file for complete search history.

(56) References Cited

U.S. PATENT DOCUMENTS 6,147,650 A * 11/2000 Kawahata et al. ..... 343/700 MS
6,369,762 B1 * 4/2002 Yanagisawa et al. .. 343/700 MS
6,535,170 B2 * 3/2003 Sawamura et al. ..... 343/702
6,911,944 B2 * 6/2005 Sekine et al. ..... 343/702
6,980,154 B2 * 12/2005 Vance et al. ..... 343/700 MS

* cited by examiner

*Primary Examiner*—Tho G Phan
(74) *Attorney, Agent, or Firm*—Blakely, Sokoloff, Taylor & Zafman

(57) ABSTRACT

Provided is a dual polarization antenna realized by using four inverted F-type radiators and a Radio Frequency Identification (RFID) reader employing the dual polarization antenna. The dual polarization antenna includes a ground plate and four inverted F-type radiators set up on the ground plate. Currents of the same phase are fed to the first and second inverted F-type radiators each other. Currents of an inverted phase are fed to the third and fourth inverted F-type radiators each other. The four inverted F-type radiators form an angle of 90° with one another. The first and second inverted F-type radiators radiate electric wave of vertical polarization and the third and fourth inverted F-type radiators radiate electric wave of horizontal polarization. Since the dual polarization antenna has excellent orthogonal and isolation characteristics, the antenna can extend a transmission distance between the reader and the tag and improve a communication quality.

11 Claims, 8 Drawing Sheets

(PRIRO ART)

DUAL POLARIZATION ANTENNA AND RFID READER EMPLOYING THE SAME

FIELD OF THE INVENTION

The present invention relates to a dual polarization antenna and a radio frequency identification reader employing the same; and, more particularly, to a dual polarization antenna realized by using four inverted F-type radiators and a Radio Frequency Identification (RFID) reader employing the dual polarization antenna.

DESCRIPTION OF RELATED ART

A dual polarization antenna radiating electromagnetic wave having two polarization characteristics should have an orthogonal characteristic between ports. Generally, the dual polarization antenna should have an input standing wave ratio of less than 1.5 and isolation of more than 25 dB between vertical and horizontal polarization ports. Also, the dual polarization antenna should have a gain of 3±1 dB since a wireless communication section between a reader and a tag has a non-directional characteristic in a Radio Frequency Identification (RFID) system.

A conventional dual polarization antenna includes two rectangular and circular metal loops which radiate electromagnetic waves orthogonal to each other. FIG. 1 is an exemplary diagram showing a conventional dual polarization antenna. Two loops 2 and 3 are formed on a ground plate 1. The two loops 2 and 3 are positioned to be orthogonal to each other and have different heights not to be electrically connected to each other. Feeding points 4 and 5 of the two loops 2 and 3 are positioned between the two loops 2 and 3 and the ground plate 1.

As shown in FIG. 1, the conventional dual polarization antenna has a structure that can hardly satisfy characteristics required for the above-mentioned dual polarization antenna.

Since the two loops 2 and 3 through current flows cross each other in the central part of an antenna, a coupling is generated between radiators to thereby deteriorate an isolation characteristic. In particular, the feeding point should be in a specific position, for example, a position between loops, in order to secure an isolation characteristic between two loops and maintain the orthogonal characteristic.

Therefore, since the conventional dual polarization antenna is more likely to induce a bit error by lowering a received power in a communication link between the reader and the tag due to a low isolation characteristic, a communication distance can be limited. Also, the conventional dual polarization antenna has a shortcoming that it is restrictive to design and manufacture the antenna.

SUMMARY OF THE INVENTION

It is, therefore, an object of the present invention to provide a dual polarization antenna which can extend a transmission distance between a reader and a tag with excellent orthogonal characteristic and a high isolation characteristic and improve a communication quality within the transmission distance.

It is another object of the present invention to provide a dual polarization antenna having a high degree of freedom in designing and manufacturing.

Other objects and advantages of the invention will be understood by the following description and become more apparent from the embodiments in accordance with the present invention, which are set forth hereinafter. It will be also apparent that objects and advantages of the invention can be embodied easily by the means defined in claims and combinations thereof.

In accordance with an aspect of the present invention, there is provided a dual polarization antenna, including: a ground plate and four inverted F-type radiators set up on the ground plate. Currents of the same phase are fed to the first and second inverted F-type radiators. Currents of inverted phases are fed to the third and fourth inverted F-type radiators. The four inverted F-type radiators form an angle of 90° with one another. The first and second inverted F-type radiators radiate electric wave of vertical polarization, and the third and fourth inverted F-type radiators radiate electric wave of horizontal polarization.

Feeding path lengths from a feeding connector of the first feeding line for feeding to the first and second inverted F-type radiators to the first and second inverted F-type radiators are the same, and a difference between feeding path lengths from a feeding connector of the second feeding line for feeding to the third and fourth inverted F-type radiators to the third and fourth inverted F-type radiators is odd number-times as much as a half-wave length of the antenna.

In accordance with another aspect of the present invention, there is provided a Radio Frequency Identification (RFID) reader, including: a dual polarization antenna; an RF transmitting block for transmitting an RF signal to an RFID tag through the dual polarization antenna; an RF receiving block for receiving the RF signal from the RFID tag through the dual polarization antenna; and a signal processing block for processing the transmitted/received RF signals. Currents of the same phase are fed to the first and second inverted F-type radiators set up on the ground plate in confrontation to each other. Currents of an inverted phase are fed to the third and fourth inverted F-type radiators set up on the ground plate in confrontation to each other. The four inverted F-type radiators form an angle of 90° with one another. The first and second inverted F-type radiators radiate electric wave of vertical polarization, and the third and fourth inverted F-type radiators radiate electric wave of horizontal polarization.

BRIEF DESCRIPTION OF THE DRAWINGS

The above and other objects and features of the present invention will become apparent from the following description of the preferred embodiments given in conjunction with the accompanying drawings, in which.

DETAILED DESCRIPTION OF THE INVENTION

Other objects and advantages of the present invention will become apparent from the following description of the embodiments with reference to the accompanying drawings. Therefore, those skilled in the art that the present invention is included can embody the technological concept and scope of the invention easily. In addition, if it is considered that detailed description on the prior art may blur the points of the present invention, the detailed description will not be provided herein. The preferred embodiments of the present invention will be described in detail hereinafter with reference to the attached drawings.

Figure 1:
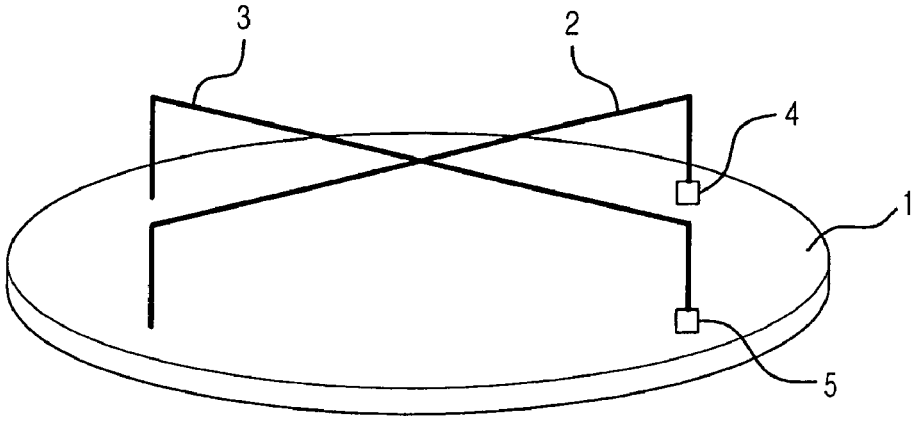
FIG. 1 is a perspective view showing a conventional dual polarization antenna.
Figure 2:
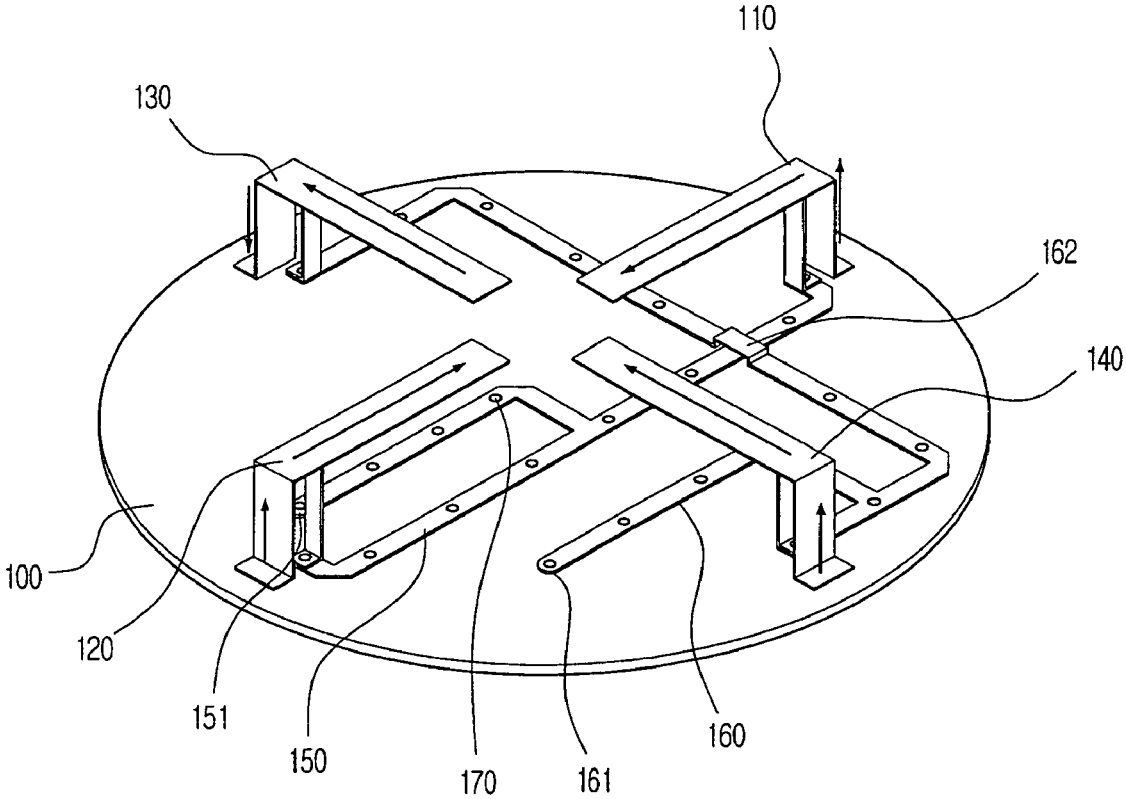
FIG. 2 is a perspective view showing an antenna using four inverted F-type radiators in accordance with an embodiment of the present invention.

FIG. 2 is a perspective view showing an antenna using four inverted F-type radiators in accordance with an embodiment of the present invention. First, second, third and fourth inverted F-type radiators 110, 120, 130 and 140 are positioned on top of a circular ground plate 100. The four inverted F-type radiators are metal strips and maintain an angle of 90° to each other. The first and second inverted F-type radiators 110 and 120 in confronting positions become a pair and form an antenna for vertical polarization, i.e., a vertical polarization antenna. Also, the third and fourth inverted F-type radiators 130 and 140 in confronting positions become another pair and form an antenna for horizontal polarization i.e., a horizontal polarization antenna. The first and second inverted F-type radiators 110 and 120 are fed with signals through a first feeding line 150. The third and fourth inverted F-type radiators 130 and 140 are fed with signals through a second feeding line 160.

Current supplied from a first feeding connector 151 to the first and second inverted F-type radiators 110 and 120 of the vertical polarization antenna is distributed and transmitted in the same phase through the first feeding line 150. Current supplied from a second feeding connector is distributed and transmitted in an inverted phase to each other to the third and fourth inverted F-type radiators 130 and 140 included in the horizontal polarization antenna through the second feeding line 160.

Open points of the four inverted F-type radiators 110, 120, 130 and 140 are formed in the center of the dual polarization antenna of the present invention. Since current is 0 in the open points, intensity of coupling between the radiators is low, thereby preventing deterioration of the isolation characteristic.

Figure 3:
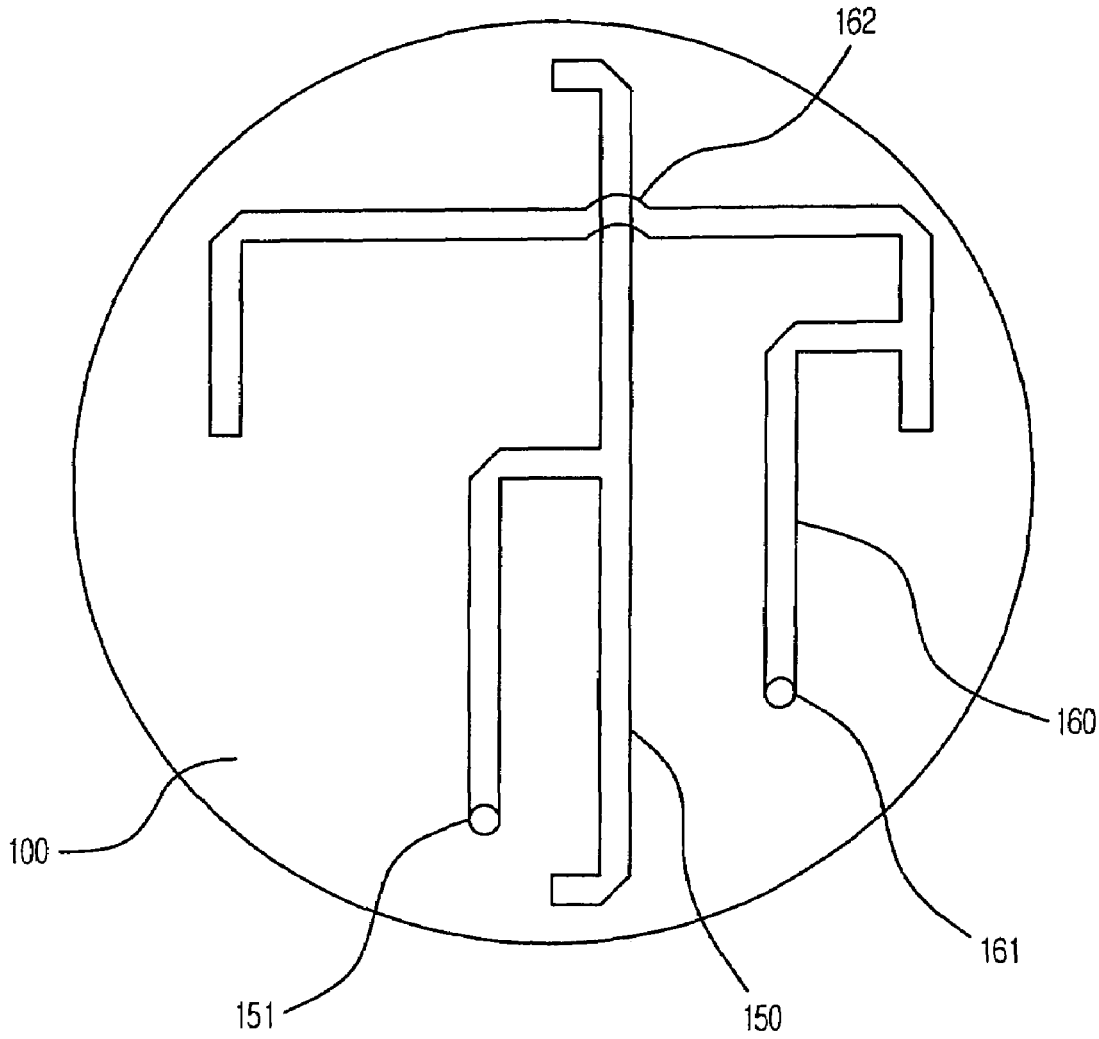
FIG. 3 is a diagram illustrating a feeding line of the antenna of FIG. 2.

FIG. 3 is a diagram illustrating a feeding line of the antenna of FIG. 2. The first and second feeding lines 150 and 160 have an air Strip feeding structure and are separated from the ground plate 100 at a predetermined distance. A plurality of plastic support bolts 170 are used to maintain the predetermined distance between the first and second feeding lines 150 and 160 and the ground plate 100. Also, a feeding part 162, which is jumped in the second feeding line 160 is formed in order to electrically separate the first and second feeding lines 150 and 160.

The first feeding line 150 provides the current inputted through the first feeding connector 151 to the first and second inverted F-type radiators 110 and 120 in the same phase. Path lengths from the first feeding connector 151 to the first and the second inverted F-type radiators 110 and 120 are the same. Therefore, the current inputted through the first feeding connector 151 is provided to the first and second inverted F-type radiators 110 and 120 in the same phase.

Meanwhile, the second feeding line 160 provides the current inputted through the second feeding connector 161 to the third and fourth inverted F-type radiators 130 and 140 in an inverted phase. Path length from the second feeding connector 161 to the third and fourth inverted F-type radiators 130 and 140 are different by a predetermined length and the current inputted through the second feeding connector can be provided to the third and fourth inverted F-type radiators 130 and 140 in inverted phases by controlling the difference between the path lengths. That is, when difference between the path lengths from the second feeding connector 161 to the third and fourth inverted F-type radiators 130 and 140 is generated odd number-times as much as a half-wave length of the antenna, the current can be provided to the third and fourth inverted F-type radiators 130 and 140 at the inverted phase.

Figure 4:
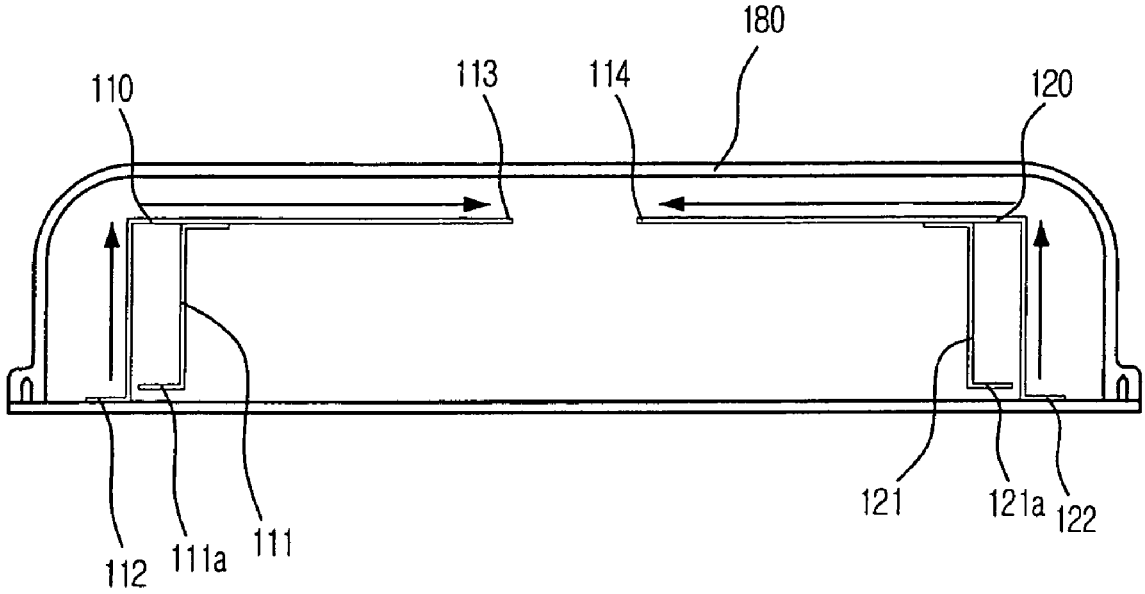
FIG. 4 is a side view showing a vertical polarization antenna of FIG. 2.

FIG. 4 is a side view showing a vertical polarization antenna of FIG. 2. Current is provided to the first inverted F-type radiator 110 through a feeding point 111*a* of the first feeding plate 111 connected to one end of the first feeding line 150. Also, the current is provided to the second inverted F-type radiator 120 through a feeding point 121*a* of a second feeding plate 121 connected to the other end of the first feeding line 150. Since the currents are distributed in the same direction, i.e., upward vertical direction in the first and second inverted F-type radiators 110 and 120 around short circuit points 112 and 122, at which the first and second inverted F-type radiators 110 and 120 contact the ground plate 100, electric wave of a vertical element in a long distance is reinforced by each other. On the contrary, since the currents are distributed in opposite directions between the first and second inverted F-type radiators 110 and 120 around the open points 113 and 114 of the first and second inverted F-type radiators 110 and 120, electric wave of a horizontal element in a long distance can be offset by each other. Therefore, the vertical polarization antenna including the first and second inverted F-type radiators 110 and 120 can radiate the electric wave of the vertical polarization. Meanwhile, a radar dome 180 can be used to protect the antenna.

Figure 5:
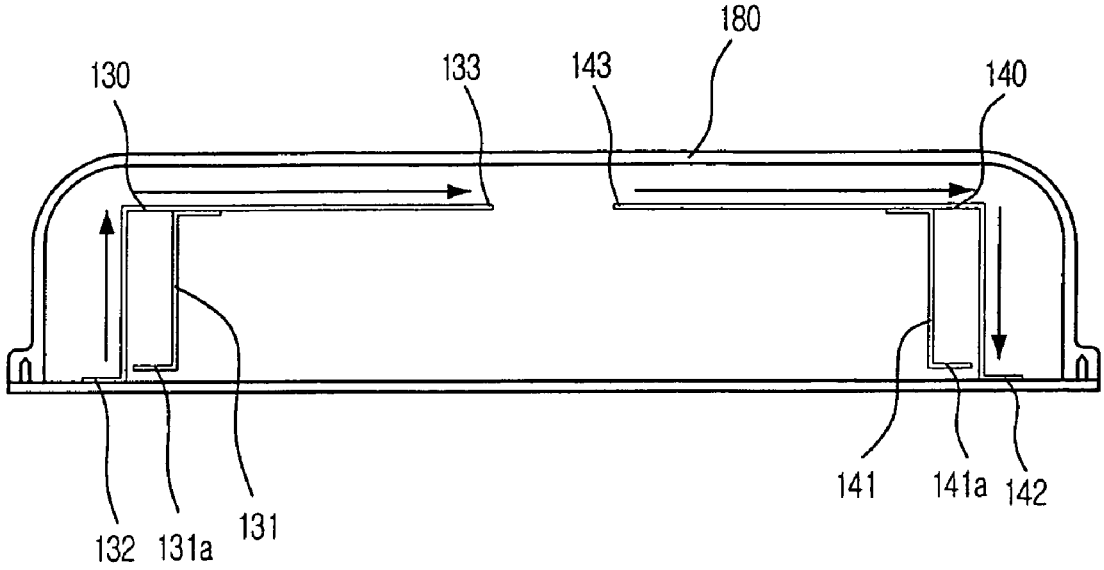
FIG. 5 is a side view showing a horizontal polarization antenna of FIG. 2.

FIG. 5 is a side view showing an antenna for the horizontal polarization of FIG. 2. Current is provided to the third inverted F-type radiator 130 through a feeding point 131*a* of the third feeding plate connected to one end of the second feeding line 160. Also, the current is provided to the fourth inverted F-type radiator 140 through a feeding point 141*a* of the fourth feeding plate connected to the other end of the second feeding line 160.

Since the currents are distributed in opposite directions to each other between the third and fourth inverted F-type radiators 130 and 140 around short circuit points 132 and 142, at which the third and fourth inverted F-type radiators 130 and 140 contact the ground plate 100, electric wave of the vertical element in a long distance can be offset by each other. On the contrary, since the currents are distributed in the same direction in the third and fourth inverted F-type radiators 130 and 140 around the open points 133 and 143 of the third and fourth inverted F-type radiators 130 and 140, electric wave of a horizontal element in a long distance can be reinforced by each other. Therefore, the horizontal polarization antenna including the third and fourth inverted F-type radiators 130 and 140 can radiate the electric wave of the horizontal polarization.

Figure 6A:
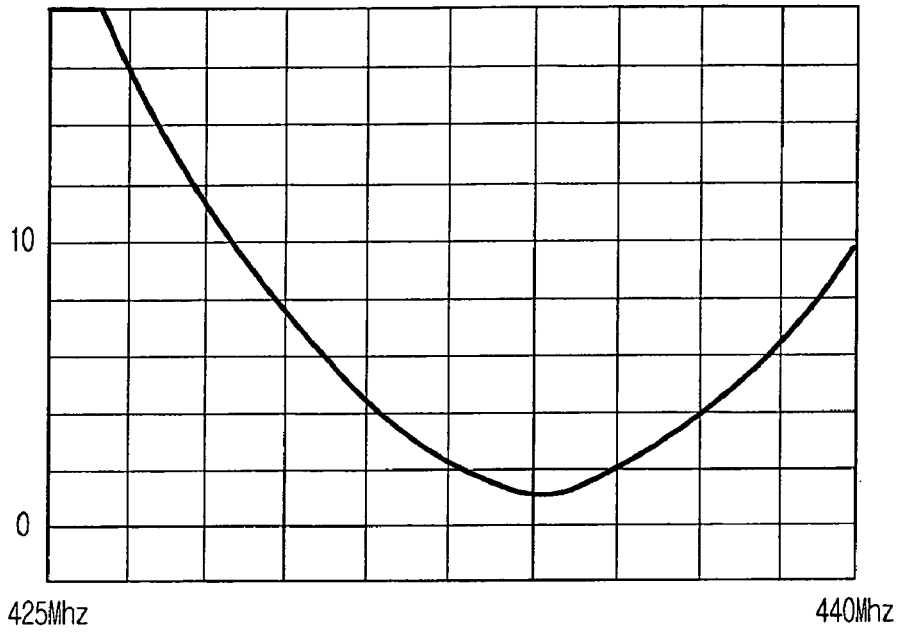
FIG. 6A is a graph showing a standing-wave ratio of a vertical polarization port.
Figure 6B:
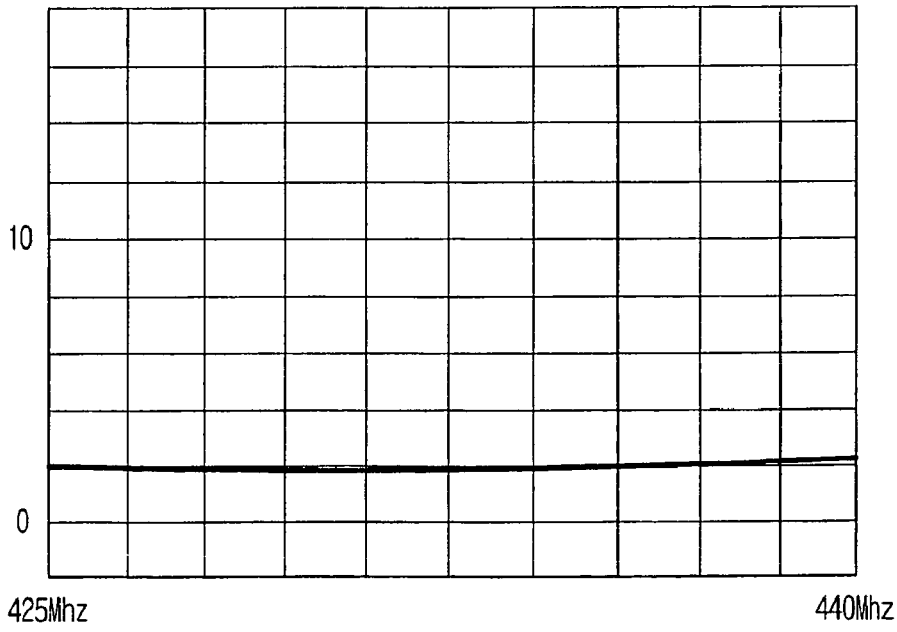
FIG. 6B is a graph showing a standing wave ratio measured in a horizontal polarization port.

FIG. 6A is a graph showing a vertical polarization port, in which the first feeding connector 151 is positioned, and FIG. 6B is a graph showing a standing wave ratio measured in a horizontal polarization port, in which the second feeding connector 161 is positioned in accordance with the embodiment of the present invention. The standing wave ratio is less than 1.5 in the vertical polarization port and the horizontal polarization port. Therefore, the dual polarization antenna of the present invention satisfies a general antenna standard of a standing wave ratio of less than 1.5 in two separate ports.

Figure 7:
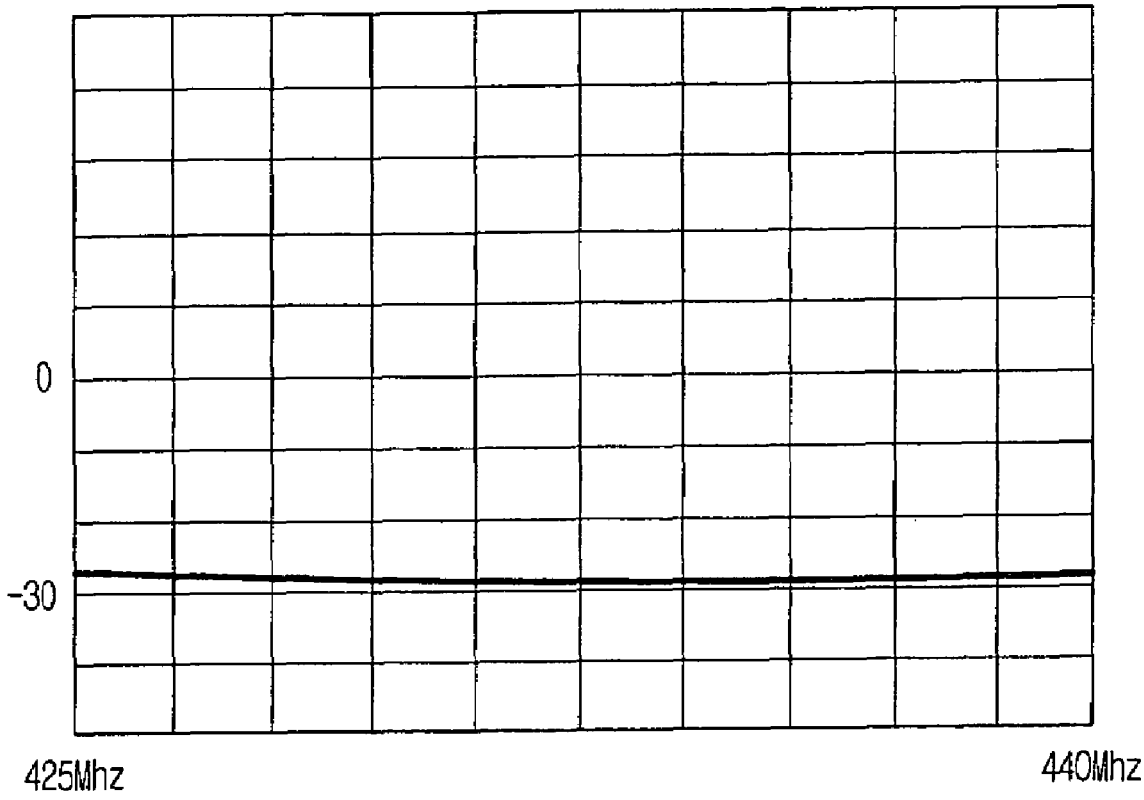
FIG. 7 is a graph showing isolation between the vertical polarization port and the horizontal polarization port.

FIG. 7 is a graph showing isolation between the vertical polarization port and the horizontal polarization port in accordance with the embodiment of the present invention. Isolation between the vertical polarization port and the horizontal polarization port is about 28 dB in a frequency of 433 MHz. Therefore, the dual polarization antenna of the present invention satisfies a general antenna standard of isolation of less than 25 dB in two separate ports.

Figure 8:
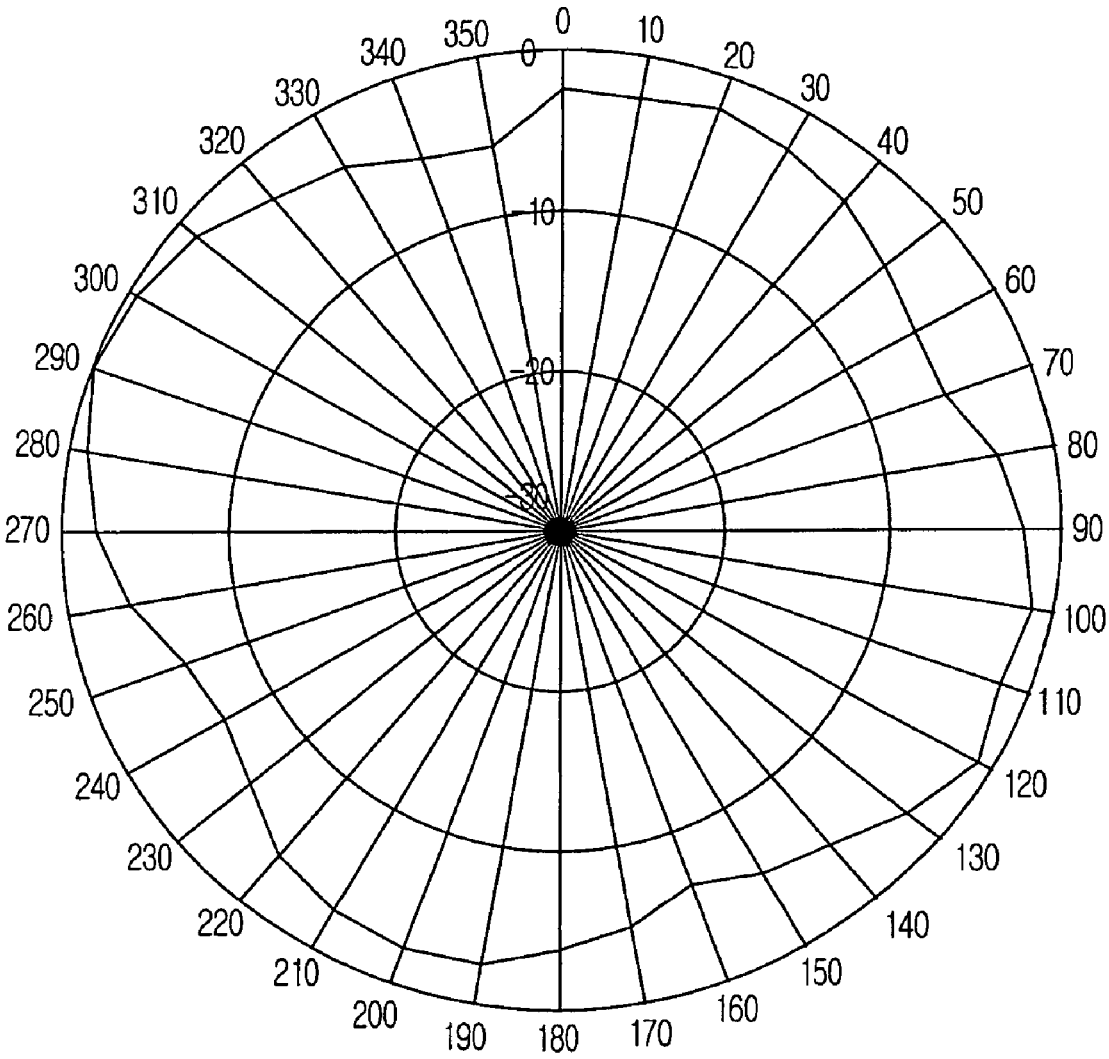
FIG. 8 is a diagram showing a beam pattern of a vertical polarization input signal in a long distance.

FIG. 8 is a diagram showing a beam pattern of the vertical polarization input signal in a long distance in accordance with the embodiment of the present invention. As shown in the drawing, the beam pattern of the vertical polarization input signal in a long distance shows a characteristic close to a non-directional radiation pattern.

Figure 9:
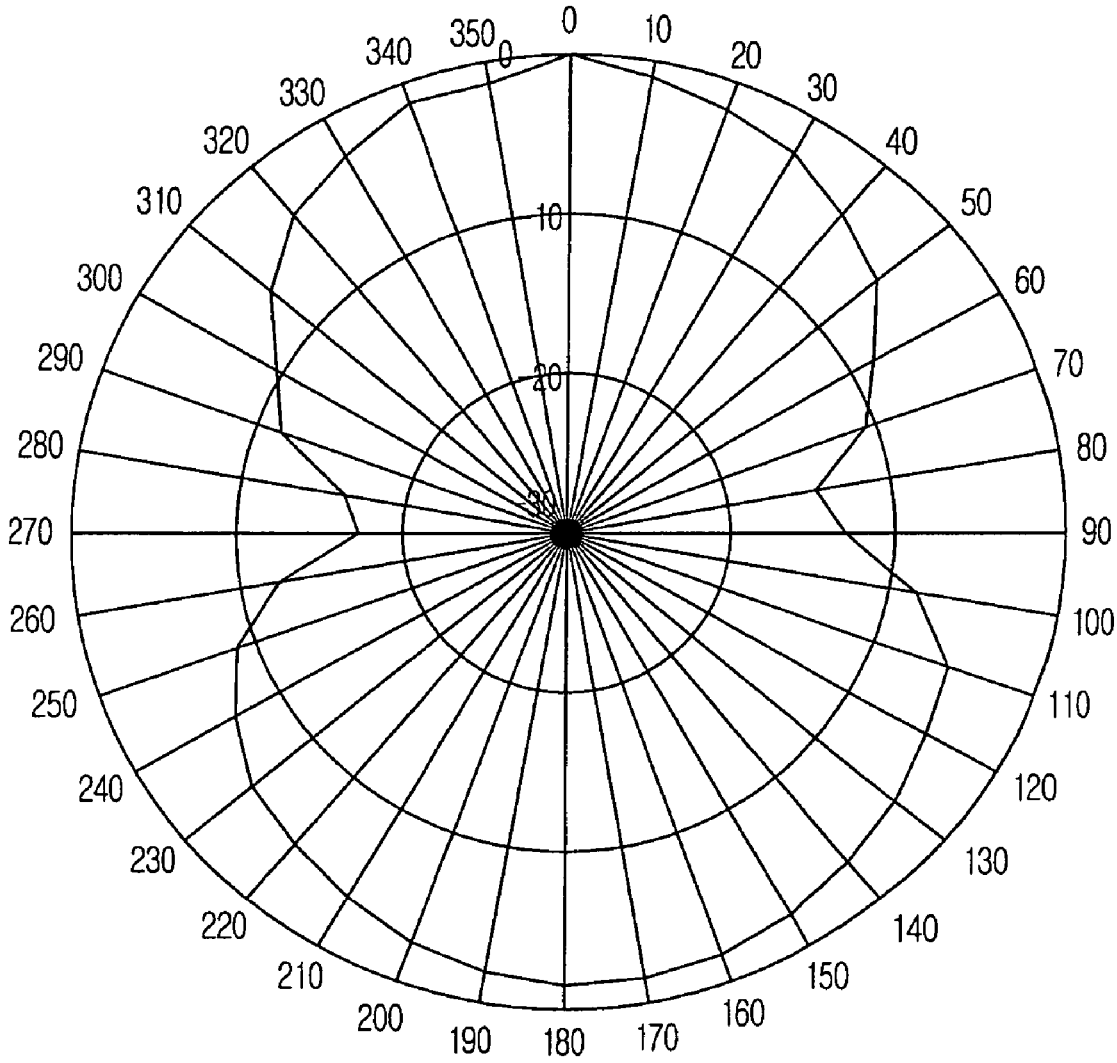
FIG. 9 is a diagram showing a beam pattern of a horizontal polarization input signal in a long distance.

FIG. 9 is a diagram showing a beam pattern of the horizontal polarization input signal in a long distance in accordance with the embodiment of the present invention. As shown in the drawing, the beam pattern in a long distance with respect to the horizontal polarization input signal shows a characteristic similar to a beam pattern of a dipole antenna.

The dual polarization antenna having above-described structure can be used as an antenna for a Radio Frequency Identification (RFID) reader. The RFID reader includes a dual polarization antenna having four inverted F-type radiators set up on a ground plate, a transmitting block for transmitting an RF signal to an RFID tag through the dual polarization antenna, a receiving block for receiving the RF signal from the RFID tag through the dual polarization antenna and a signal processing block for processing the transmitted/received RF signals. Since the RFID reader of the present invention can have the same structure as a conventional RFID reader except the dual polarization antenna structure, detailed description will not be provided herein.

Since the present invention has an excellent orthogonal characteristic and a high isolation characteristic, the present invention can extend a transmission distance between the reader and the tag and improve a communication quality within the transmission distance.

The present invention can produce an antenna having high isolation and excellent degree of freedom in designing and producing.

The present application contains subject matter related to Korean patent application Nos. 2004-0103079 and 2005-0077357 filed with the Korean Intellectual Property Office on Dec. 8, 2004 and Aug. 23, 2005, respectively, the entire contents of which are incorporated herein by reference.

While the present invention has been described with respect to certain preferred embodiments, it will be apparent to those skilled in the art that various changes and modifications may be made without departing from the scope of the invention as defined in the following claims.

What is claimed is:

1. A dual polarization antenna, comprising: a ground plate;

first and second inverted F-type radiators set up on the ground plate in confrontation to each other; and third and fourth inverted F-type radiators set up on the ground plate in confrontation to each other, wherein currents of the same phase are fed to the first and second inverted F-type radiators; and currents of an inverted phases are fed to the third and fourth inverted F-type radiators, wherein the first and third inverted F-type radiators form an angle of 90° with one another; and the second and fourth inverted F-type radiators form an angle of 90° with one another; and the first and second inverted F-type radiators form an angle of 0° with one another;

and the third and fourth inverted F-type radiators form an angle of 0° with one another.

2. The antenna as recited in claim 1, further comprising:

a first feeding line for feeding the first and second inverted F-type radiators; and a second feeding line for feeding the third and fourth inverted F-type radiators, wherein feeding path lengths from a feeding connector of the first feeding line to the first and second inverted F-type radiators are the same, and a difference between feeding path lengths from a feeding connector of the second feeding line to the third and fourth inverted F-type radiators is odd number-times as much as a half-wave length of the antenna.

3. The antenna as recited in claim 2, wherein the first and second feeding lines have an air strip structure and are positioned at a predetermined distance from the ground plate.

4. The antenna as recited in claim 3, wherein the first and second feeding lines are electrically separated from each other.

5. The antenna as recited in claim 1, wherein the first and second inverted F-type radiators radiate electric wave of vertical polarization, and the third and fourth inverted F-type radiators radiate electric wave of horizontal polarization.

6. A Radio Frequency Identification (RFID) reader, comprising:

a dual polarization antenna;

an RF transmitting means for transmitting an RF signal to an RFID tag through the dual polarization antenna;

an RF receiving means for receiving the RF signal from the RFID tag through the dual polarization antenna; and a signal processing means for processing the transmitted/received RF signals, wherein the dual polarization antenna includes: a ground plate; first and second inverted F-type radiators set up on the ground plate in confrontation to each other; and third and fourth inverted F-type radiators set up on the ground plate in confrontation to each other, wherein currents of the same phase are fed to the first and second inverted F-type radiators each other, currents of an inverted phase are fed to the third and fourth inverted F-type radiators each other.

7. The RFID reader as recited in claim 6, wherein the four inverted F-type radiators form an angle of 90.degree. with one another.

8. The RFID reader as recited in claim 6, further comprising:

a first feeding line for feeding the first and second inverted F-type radiators; and a second feeding line for feeding the third and fourth inverted F-type radiators, wherein feeding path lengths from a feeding connector of the first feeding line to the first and second inverted F-type radiators are the same; and a difference of feeding path lengths from a feeding connector of the second feeding line to the third and fourth inverted F-type radiators is odd number-times as much as a half-wave length of the antenna.

9. The RFID reader as recited in claim 8, wherein the first and second feeding lines have an air strip structure and are positioned at a predetermined distance from the ground plate.

10. The RFID reader as recited in claim 9, wherein the first and second feeding lines are electrically separated from each other.

11. The RFID reader as recited in claim 6, wherein the first and second inverted F-type radiators radiate electric wave of vertical polarization, and the third and fourth inverted F-type radiators radiate electric wave of horizontal polarization.

* * * * *